United States Patent [19]

Rea

[11] Patent Number: 4,475,981

[45] Date of Patent: Oct. 9, 1984

[54] METAL POLISHING COMPOSITION AND PROCESS

[75] Inventor: William V. Rea, Newark, Calif.

[73] Assignee: Ampex Corporation, Redwood City, Calif.

[21] Appl. No.: 546,783

[22] Filed: Oct. 28, 1983

[51] Int. Cl.[3] ..... C23F 1/00; B44C 1/22; C03C 15/00; C03C 25/06

[52] U.S. Cl. ..... 156/636; 51/307; 51/317; 156/645; 156/664; 156/903; 252/79.1

[58] Field of Search ..... 156/636, 637; 6/645, 6/656, 664, 903; 252/79.1, 79.2, 79.5; 51/317, 281 R, 293, 295, 307–309, DIG. 20

[56] References Cited

U.S. PATENT DOCUMENTS

| | | | |
|---|---|---|---|
| 3,342,652 | 9/1967 | Reisman et al. | 156/636 |
| 3,429,080 | 2/1969 | Lachapelle | 51/309 |
| 4,011,099 | 3/1977 | Gutsche | 156/645 |
| 4,305,779 | 12/1981 | Steeves et al. | 156/636 |
| 4,412,886 | 11/1983 | Sakaguchi et al. | 156/645 |

*Primary Examiner*—William A. Powell

*Attorney, Agent, or Firm*—Thomas E. Ciotti; Ralph L. Mossino; Joel D. Talcott

[57] ABSTRACT

Metal surfaces such as the working surfaces of nickel plated blanks for rigid memory discs are polished in a two-stage process of rough and finish polishing by a combination of mechanical and chemical mechanisms. Each stage involves a plurality of cycles in which the surface is polished using a rotating polishing pad with an aqueous suspension of aluminum oxide containing a lubricant-surfactant and a chlorine-containing oxidizing agent present at the surface-pad interface followed by the addition of an aqueous colloidal aluminum oxide sol to the oxidizing agent-containing suspension at the interface which frees the chlorine in the oxidizing agent to exert a chemical polishing action on the surface.

23 Claims, No Drawings

METAL POLISHING COMPOSITION AND PROCESS

DESCRIPTION

1. Technical Field

This invention is in the field of metal polishing. More particularly it relates to a composition and process for polishing electroless nickel or nickel alloy plated surfaces such as the surfaces of the substrates to which ferromagnetic films are applied in the manufacture of memory discs.

2. Background Art

Rigid memory discs are conventionally made of aluminum substrate or blank which is plated by electroless plating, sputtering or vacuum deposition with a nickel-phosphorous alloy. In electroless plating of nickel a continuous film of nickel is deposited on the base by the interaction in solution of a nickel salt and a chemical reducing agent. The bath used in the plating contains the nickel salt and the reducing agent and may also contain other additives such as stabilizers, buffers, complexing agents, and the like. The resultant nickel coating is non-magnetic, amorphous, and sufficiently hard to prevent unwanted impressions or non-uniformities in the surface of the finished disc. However, the surface of the nickel or nickel alloy is rough and non-uniform. This prevents the magnetic head from properly flying against the disc surface.

After the nickel or nickel alloy plating is applied, the working surface of the plated substrate is typically polished to give it suitable surface characteristics. In the past polishing has been carried out by grinding the surface or polishing the surface with polishing pads such as those used to polish silicon wafers. Polishing compositions such as slurries or pastes of abrasive materials such as particulate silicon carbide have been used in conjunction with the grinding or polishing pads. These prior polishing procedures have generally involved costly supplies, have relied heavily on operator monitoring of the polishing or grinding, and have been time-consuming.

This new polishing technique of the invention planarizes and removes the nickel-phosphorous surface roughness and provides means for polishing nickel or nickel alloy plated memory substrates by a chemical/-mechanical action rather than a purely mechanical one. The invention eliminates the need for surface grinding and significant operator monitoring and reliably produces high quality polished surfaces ready for applying the thin film magnetic medium by means of electro- or electroless plating, vacuum deposition, or sputtering.

DISCLOSURE OF THE INVENTION

One aspect of the invention is a composition for polishing a corrodible metal surface comprising a mixture of:

(a) an aqueous suspension of ceric oxide or aluminum oxide powder containing a water soluble chlorine-containing mild oxidizing agent;

(b) an aqueous suspension of colloidal aluminum oxide or ceric oxide, the mixture having a pH at which chlorine in the mixture is free.

Another aspect of the invention is a composition for polishing a nickel or nickel alloy surface prepared by mixing:

(a) an aqueous suspension of aluminum oxide powder containing a water soluble chlorine-containing mild oxidizing agent; and (b) an aqueous suspension of colloidal aluminum oxide, under conditions that cause the resulting mixture to have a pH at which chlorine in the mixture is free.

Another aspect of the invention is a process for polishing a corrodible metal surface comprising:

(a) mechanically rubbing the surface while (b) contacting the surface with the above described composition for polishing a corrodible metal surface.

Another aspect of the invention is a process for polishing a nickel or nickel alloy surface comprising:

(a) mechanically rubbing the surface by contacting the surface with a rotating polishing pad;

(b) contacting the surface with an aqueous suspension of aluminum oxide powder containing a chlorine-containing mild oxidizing agent; and (c) thereafter applying an aqueous suspension of colloidal aluminum oxide to the surface while the rubbing is continued whereby the aqueous suspension of (b) is mixed therewith causing chlorine in the aqueous suspension of (b) to be freed.

MODES FOR CARRYING OUT THE INVENTION

While the compositions and processes of the invention are particularly suited to polishing the working surfaces of nickel or nickel alloy plated blanks intended for use in manufacturing rigid memory discs, it will be appreciated that they may also be used to polish other nickel plated substrates such as various auto parts and the valve sets on internal combustion engines. The invention may also be used to polish other metal surfaces that are susceptible to mechanical polishing and dissolution by the oxidizing agent contained in the polishing composition.

The polishing composition is a mixture of two aqueous suspensions of either aluminum oxide ($Al_2O_3$) or ceric oxide ($CeO_2$). Aluminum oxide is preferred because of its availability and cost.

The first suspension contains aluminum oxide powder having a nominal crystal size below about one micron, preferably about 0.1 to 0.5 micron, and most preferably about 0.3 micron. Such powders are commonly referred to as "alumina polishing powders" and are commercially available from companies such as Union Carbide Corp., Indianapolis, Ind. The concentration of aluminum oxide powder in this suspension will usually be about 1 to 5% by volume, more usually about 2 to 3% by volume. The other main ingredient of this suspension is a water soluble chlorine-containing oxidizing agent. The oxidizing agent is stable in the suspension and does not liberate a substantial amount of nascent chlorine until it is mixed with the other suspension. The oxidizing agent is preferably a hypochlorite. Sodium hypochlorite is a preferred oxidizing agent. The amount of oxidizing agent in the suspension, will usually be in the range of about 0.05% to 0.3% by volume, more usually about 0.1% to 0.15% by volume. In the case of sodium hypochlorite, the amount of hypochlorite in the suspension will usually be in the range of 0.1% to 0.15% by volume, and preferably about 0.12% by volume. In the preferred embodiment of the polishing composition this first suspension also contains a minor amount, usually 0.1% to 1 % by volume, of the suspension of a lubricant-surfactant. Lapping compounds such as those sold under the trademark Silconox Lap by Premier Chemical Corp., Pleasanton, Calif., are suitable lubricant-surfactants. The lubricant-surfactant serves to lubricate the interface between the surface begin polished and the mechanial polishing medium as well as keep the aluminum oxide particles suspended. Distilled water is a preferred aqueous suspending medium. The pH of this suspension will usually be slightly basic, typically about 9.2 to 10.2, more usually about 9.6.

The second suspension also contains colloidal aluminum oxide or ceric oxide. Again, colloidal aluminum oxide is preferred because of its availability and cost. The nominal crystal size of this aluminum oxide is in the colloidal range (approximately 10 to 10,000 Å). Colloidal alumina-coated silica is an alternative to pure colloidal alumina. As used herein the term "colloidal aluminum oxide" is intended to include both pure colloidal aluminum oxide as well as alumina-coated particles of colloidal size. The particles of aluminum oxide in this dispersion are typically positively charged and stabilized by the presence of a small amount of chloride ion. They are typically stable at acidic pHs, e.g., about 2 to 6. The concentrations of aluminum oxide in these dispersions will usually be about 5% to 10% by volume, more usually about 6% to 8% by volume (about 15:1 volume ratio).

It is believed that when the two suspensions are mixed that the pH of the resulting mixture is such that the oxidizing agent therein becomes unstable and liberates chlorine which is available to attack the metal surface being polished. The two suspensions will usually be mixed in volume proportions of about 3:1 to 1:1 (oxidizing agentcontaining first suspension:second suspension).

Metal surfaces such as nickel-plated blanks for rigid memory discs are polished with the above described composition by subjecting the surface to mechanical rubbing (polishing) in the presence of the composition. The rubbing effects mechanical smoothing or wear of the surface which is aided by the abrasive properties of the aluminum oxide, whereas the oxidizing agent effects a mild chemical attack and dissolution of the surface. Polishing is thus achieved by a combination of chemical and mechanical mechanisms.

The mechanical rubbing or polishing is conveniently effected by contacting the metal surface with a polishing pad under a predetermined compressive force with relative motion between the pad and the surface. The resulting dynamic friction between the pad and the surface causes the desired wear and smoothing of the surface. The relative motion is preferably achieved through rotation of either or both the surface and the pad. Commercially available polishing pads that are used to polish glass or wafers in the electronics industry may be used. These pads are typically composed of a microporous polymer such as polyurethane foam, optionally backed with a substrate such as felt, latex filled felt, dense polyurethane, or latex. The pads used in the invention process are preferably perforated. The coefficients of friction of the surfaces of those pads vary and it is within the scope of the invention to carry out the process using a multiplicity of stages (e.g., rough polish followed by a finish polish) using pads having different coefficients of friction. For instance when the process involves a rough polish stage followed by a finish polish stage, the pad used in the finish polish stage has a lower coefficient of friction than the pad used in the rough polish stage.

The polishing machines that are used to polish silicon wafers and the like in the electronics industry may be adapted for use in polishing the plated disc blanks. These machines basically consist of a pair of platens. One of the platens carries a rack on which one or more discs may be mounted. The other platen carries a driven rotable plate on which the polishing pad is mounted. The machine includes means for controlling the pressure between the platens, means for controlling the temperature of the platens, and means for injecting one or more fluids into the interface between the platens. The preferred mode for practicing the invention process employs such a machine.

In this preferred mode the plated disc blanks are mounted on one platen and the desired polishing pad on the other. The platens are brought together while the polishing pad is rotated, typically at about 40 to 80 rpm, more usually about 55 to 65 rpm. The suspension containing the oxidizing agent is simultaneously applied to the interface via the fluid injecting means. The fluid injecting means is preferably configured so that fluid is injected both at the center and midpoint of the plated disc blank. The suspension lubricates the interface and the aluminum oxide therein aids in the mechanical polishing of the discs' surfaces. The pressure between the platens during this stage of the process is usually in the range of 75 to 300 psi head-platen pressure (0.75 to 3.0 material pressure, psi per square inch), more usually 75 to 180 psi head-platen pressure (0.75 to 1.8 material pressure, psi per square inch). The polishing in this stage is essentially mechanical. The duration of this first stage of polishing will usually be in the range of 1 to 10 min, more usually 4 to 6 min. Following this first stage, the second colloidal aluminum oxide suspension is applied to the interface that is already wetted by the oxidizing agent-containing suspension. The addition of the second suspension liberates chlorine from the oxidizing agent thereby effecting chemical attack and dissolution of the surface. Thus, the polishing in the second stage is both mechanical and chemical. The pressure between the platens in the second stage will usually be in the range of 150 to 180 psi head-platen pressure (1.5 to 1.8 material pressure, psi per square inch). The duration of the second stage will usually be about 1 to 10 min, more usually 1 to 2 min. The temperature is maintained in a range of about 10° C. to about 45° C., preferably about 25° C. to about 35° C. throughout both stages. When the polishing is completed the platens are separated and the plated disc blanks are removed and washed with water. The discs may then be subjected to various post-polishing steps such as texturing and application of the ferromagnetic thin film.

The following example further illustrates the composition and process. This example is not intended to limit the invention in any manner.

A suspension of $Al_2O_3$ powder containing a lubricant and oxidizing agent (rough slurry) was made using the following recipe.

| Ingredient | Amount |
|---|---|
| distilled $H_2O$ | 250 gal |
| $Al_2O_3$ (Linde, Type A 0.3 min nominal crystal size) | 20 lb |
| sodium hypochlorite, aqueous solution, 5.25% | 6 gal |
| lubricant, Silconox Lap lapping compound | 650 ml |

This suspension had a pH of about 9.6 and a specific gravity of 1.005.

Nalco ISJ-612 alumina-coated silica sol was used as the suspension of colloidal aluminum oxide (finish slurry). The sol was mixed with distilled water at 13.5 gal of sol to 200 gal distilled water. The average crystal size of the particles in this suspension is given as 20 millimicrons.

These suspensions were stored separately in holding vessles, equipped with stirrers. The vessels were connecting to the valving of two polishing machines standard in commerce, as described herein. The machines were equipped with platen temperature controllers, set in the range of 25° C. to 35° C.

The polishing was done in a two stage operation using two machines; one for rough polishing, the other for finish polishing.

Electroless plated Ni 5¼inch memory discs (Al base) were mounted on carriers and the carriers were mounted on the head platen of the rough polish machine. The base platen of the rough polish machine carried a Rodel 205 perforated polishing pad rotated at approximately 65 rpm. The base platen of the finish polish machine carried a Compo 4600 A non-perforated polishing pad rotated at approximately the same speed. The machines were each equipped with four slurry feed lines, two of them rough slurry lines, one located at the center of the base platen and the other located at the midpoint of the polishing pad on the base platen. The remaining two lines are for finish slurry and wash. Rough and finish slurries were fed through the lines at the flow rates and positions indicated below.

Rough slurry, center: 12 gph
Rough slurry, midpoint: 6 gph
Finish slurry, center: 18 gph
Wash (deionized water), center: 24 gph Head-platen pressures were as follows:

Rough polish-high: 150 psi
Rough polish-low: 75 psi
Finish polish-high: 180 psi
Finish polish-low: 150 psi The rough polish stage comprised four cycles as follows:

Cycle 1: rough slurry and rinse, low head pressure, one min.
Cycle 2: rough slurry, high head pressure, 2.5 min.
Cycle 3: finish slurry, high head pressure, one min.
Cycle 4: rinse, low pressure, 0.5 min.

After the rough polish stage, the carriers were removed from the rough polish machine and transferred to the finish polishing machine. The finish polish stage comprised three cycles as follows:

Cycle 1: rough slurry, low pressure, 0.5 min.
Cycle 2: finish slurry, high pressure, one min.
Cycle 3: rinse, low pressure, 0.5 min.

After one side of the plate disc blanks were polished, the plated blanks were turned over and their other sides were polished as above.

Modifications of the above-described modes for carrying out the invention that are obvious to those of skill in the fields of chemistry, metal polishing, recording media, and related fields are intended to be within the scope of the following claims.

I claim:

1. A composition for polishing a corrodible metal surface comprising a mixture of:

(a) an aqueous suspension of ceric oxide or aluminum oxide powder containing a water soluble chlorine-containing mild oxidizing agent; and
(b) an aqueous suspension of colloidal aluminum oxide or ceric oxide, the mixture having a pH at which chlorine in the mixture is free.

2. The composition of claim 1 wherein the metal is nickel or a nickel alloy.

3. The composition of claim 1 wherein the corrodible metal surface is the surface of a nickel or nickel alloy plated blank for a magnetic memory disc.

4. The composition of claim 1 wherein the particle size of the ceric oxide or aluminum oxide powder is below about one micron and the particle size of the colloidal aluminum oxide or ceric oxide is below about 20 millimicrons.

5. The composition of claim 1 wherein the particle size of the ceric oxide or aluminum oxide powder is about 0.1 to about 0.5 microns.

6. The composition of claim 1 wherein the oxidizing agent is sodium hypochlorite.

7. The composition of claim 1 wherein (a) also contains a lubricant-surfactant.

8. The composition of claim 6 wherein (a) contains about 0.1% to 0.15% by volume hypochlorite and the volume proportion of (a) to (b) is in the range of about 1 to 1 to about 3 to 1.

9. The composition of claim 1 wherein the concentration of ceric oxide or aluminum oxide in (a) is about 1% to 5% by volume and the concentration of colloidal ceric oxide or aluminum oxide in (b) is about 5% to 10% by volume.

10. A composition for polishing a nickel or nickel alloy surface comprising a mixture of (a) an aqueous suspension of aluminum oxide having a nominal crystal size of less than about one micron containing a lubricating agent and a chlorine-containing mild oxidizing agent; and
(b) an aqueous suspension of colloidal aluminum oxide, wherein the volume ratio of (a) to (b) is about 1:1 to 3:1 and the mixture has a pH at which chlorine in the mixture is free.

11. A composition for polishing a nickel or nickel alloy surface prepared by mixing:

(a) an aqueous suspension of aluminum oxide powder containing a water soluble chlorine-containing mild oxidizing agent; and
(b) an aqueous suspension of colloidal aluminum oxide under conditions that cause the resulting mixture to have a pH at which chlorine in the mixture is free.

12. A process for polishing a corrodible metal surface comprising:

(a) mechanically rubbing the surface while
(b) contacting the surface with the composition of claim 2.

13. The process of claim 12 wherein the mechanical rubbing is carried out by contacting the surface with a rotating polishing pad.

14. The process of claim 13 wherein the process is carried out at a temperature in the range of about 10° C. to about 45° C.

15. The process of claim 14 wherein the polishing pad is applied to the surface under a force of about 75 to 300 psi and the pad is rotated at about 40 to 80 rpm.

16. A process for polishing a nickel or nickel alloy surface comprising:

(a) mechanically rubbing the surface while (b) contacting the surface with the composition of claim 10.

17. The process of claim 16 wherein the mechanical rubbing is carried out by contacting the surface with a rotating polishing pad.

18. The process of claim 17 wherein the process is carried out at a temperature in the range of about 25° C. to about 35° C.

19. The process of claim 18 wherein the polishing pad is applied to the surface under a force of about 75 to 180 psi and the pad is rotated at about 55 to 65 rpm.

20. A process for polishing a nickel or nickel alloy surface comprising:

(a) mechanically rubbing the surface while (b) contacting the surface with the composition of claim 11.

21. A process for polishing a nickel or nickel alloy surface comprising:

(a) mechanically rubbing the surface by contacting the surface with a rotating polishing pad;

(b) contacting the surface with an aqueous suspension of aluminum oxide powder containing a chlorine-containing mild oxidizing agent; and (c) thereafter applying an aqueous suspension of colloidal aluminum oxide to the surface while the rubbing is continued whereby the aqueous suspension of (b) is mixed therewith causing chlorine in the aqueous suspension of (b) to be freed.

22. The process of claim 21 wherein the particle size of the aluminum oxide powder is below about one micron, the oxidizing agent is sodium hypochlorite and the suspension of (b) contains about 0.12% by volume hypochlorite.

23. A two stage process for polishing a nickel or nickel alloy-plated memory disc comprising:

(a) a rough polishing stage in which the surface of the disc is mechanically rubbed under a pressure of about 75 to 150 psi with a first polishing pad in the presence of a first aqueous suspension of aluminum oxide powder containing a chlorine-containing mild oxidizing agent, followed by the addition of a second aqueous suspension of colloidal aluminum oxide to the first aqueous suspension; followed by (b) a finish polishing stage in which the surface of the disc is mechanically rubbed under a pressure of about 150 to 180 psi with a second polishing pad having a lower coefficient of friction than the first polishing pad in the presence of said first aqueous suspension, followed by the addition of said second aqueous suspension.

* * * * *